US006090024A

United States Patent [19]

Tsou

[11] Patent Number: 6,090,024

[45] Date of Patent: Jul. 18, 2000

[54] ADJUSTABLE INVERSION SUPPORTER

[76] Inventor: Yeong Haw Tsou, 9515 E. Naomi Ave., Arcadia, Calif. 91007

[21] Appl. No.: 09/106,329

[22] Filed: Jun. 29, 1998

Related U.S. Application Data

[60] Provisional application No. 60/083,706, Apr. 29, 1998.

[51] Int. Cl.[7] ..... A63B 26/00

[52] U.S. Cl. ..... 482/142; 482/144; 482/148

[58] Field of Search ..... 482/142, 144, 482/148, 23, 41, 42

[56] References Cited

U.S. PATENT DOCUMENTS

| | | | |
|---|---|---|---|
| D. 256,706 | 9/1980 | Gartin . | |
| 3,077,347 | 2/1963 | Nova | 482/142 |
| 3,114,545 | 12/1963 | Horn | 482/142 |
| 3,173,415 | 3/1965 | Rubin | 482/142 |
| 3,591,173 | 7/1971 | Cossman | 482/142 |
| 3,679,203 | 7/1972 | Grana | 482/142 |
| 3,857,561 | 12/1974 | Cecchettini | 481/142 |
| 3,879,033 | 4/1975 | Martin | 482/142 |
| 4,133,524 | 1/1979 | Barlew | 482/142 |
| 4,337,942 | 7/1982 | Sidlinger | 482/142 |
| 4,357,011 | 11/1982 | Voris . | |
| 4,815,732 | 3/1989 | Mahvi | 482/142 |
| 5,221,246 | 6/1993 | Torii | 482/144 |
| 5,577,987 | 11/1996 | Brown | 482/142 X |
| 5,603,682 | 2/1997 | Grider | 482/142 |

*Primary Examiner*—Richard J. Apley
*Assistant Examiner*—William La Marca
*Attorney, Agent, or Firm*—Raymond Y. Chan; David and Raymond

[57] ABSTRACT

An adjustable inversion supporter includes a supporting base, a pair of supporters spacedly mounted on top of the supporting base, and a pair of shoulder seats which are connected to the two supporters respectively for supporting the two shoulders of an inverse user. Each of the shoulder seats consists of a kidney-bean shaped supporting pad for enabling the respective shoulder of the inverse user to rest and be supported thereon, and an adjustable connector affixed to the supporting pad for connecting the supporting pad with the respective supporter, wherein the two supporting pads are capable of adjusting a distance therebetween by turning each of the supporting pads about the respective supporter so as to match the user's shoulder shape and width.

13 Claims, 6 Drawing Sheets

ADJUSTABLE INVERSION SUPPORTER

CROSS REFERENCE RELATED TO THE PRESENT INVENTION

This is a regular utility application of a previous provisional application Ser. No. 60/083,706, filed Apr. 29, 1998.

FIELD OF THE PRESENT INVENTION

The present invention relates to an inversion apparatus, and more particularly to an adjustable inversion supporter that provides the user a comfortable and balancing support of inversion for the enhancing blood circulation under safe condition.

BACKGROUND OF THE PRESENT INVENTION

In the coming 21st century, the technology grows at an exciting rate. Although there is highly advanced technology available today, no technology can compare with the design of human body.

Human body is one of the most delicate computers that has ever been built. Each human body has a central processing unit (CPU), which is the brain, and many functional components, such as eyes for seeing, ears for hearing, nose for breathing and smelling, mouth for feeding and talking, hands for working, and legs for moving. It is very interesting that the heart is located at an upper left side of a human body, so that the heart is able to pump blood to the brain and other parts of the body under the existence of gravity. If one's heart is located at the bottom of his foot, then he may need a much more powerful heart to pump the blood all the way up to his brain. The brain always needs fresh blood to perform proper function. You feel dizzy or have headache when there is a shortage of fresh blood in your head.

Every well-constructed machine still needs proper maintenance; human body has no exception. We can take well care of our bodies by eating food, drinking nutrient, and having proper rest to reenergize our bodies. Furthermore, when you invert your body, your heart can get better rest because the blood becomes easier to pump from the heart to your brain due to the gravity. Your brain also gets many benefits when more fresh blood is supplied to your brain, in which the brain cells are charged up to help you think better and make better decision with clear mind.

Although we know that body inversion has many benefits to human body, we also know that the body inversion is not a simple task that can be performed by anyone. In order to perform body inversion, one must be well trained with strong hands and arms to support the weight of the entire body. This is very dangerous, especially, to those beginners because wrong positioning can easily lead to torn muscles and cause back injury. Practically, the body inversion time can only last as long as the hands are able to support the body weight, which is usually a very short period of time before any significant healthy result can be achieved.

The most common and easiest body inversion method is the three-point supporting method. The three points include two hands and a head. This is much easier than just supporting by two hands along. However, this method is also much more dangerous than just supporting by hands because the body inversion practitioner is using his or her head to provide additional support. The head is directly connected to the practitioner's neck which is not designed to support much stress. Therefore, when people practice body inversion by using their heads as one of the supporting points, there might have more harm done to their bodies than goodness.

SUMMARY OF THE PRESENT INVENTION

The main objective of the present invention is to provide an adjustable inversion supporter which allows the user to safely and easily invert by supporting the user's shoulders.

Another objective of the present invention is to provide an adjustable inversion supporter, which comprises a pair of shoulder seats for providing comfortable and balancing support to the user's shoulders, wherein a distance between the two shoulder seats can be adjusted to fit the different shoulder width of different users. Therefore, different users in the family such as father, mother or children having different shoulder width can commonly use the same inversion adjustable supporter.

Another objective of the present invention is to provide an adjustable inversion supporter which can be detached and folded to reduce its size when it is not in use so as to minimize the storing space.

In order to achieve the above objectives, the present invention provides an adjustable inversion supporter which comprises a supporting base, a pair of supporters spacedly mounted on top of the supporting base, and a pair of shoulder seats which are connected to the two supporters respectively for supporting the two shoulders of a user. Each of the shoulder seats comprises a kidney-bean shaped supporting pad for enabling the respective shoulder of the user to rest and be supported thereon, and an adjustable connector affixed to the supporting pad for connecting the supporting pad with the respective supporter, wherein the two supporting pads are capable of adjusting a distance therebetween by turning each of the supporting pads about the respective supporter. A locking means may also be equipped for locking the connectors in position so as to prevent any undesired movement of the supporting pads after the user is supported thereon.

DETAILED DESCRIPTION OF THE PREFERRED EMBODIMENT

Figure 4B:
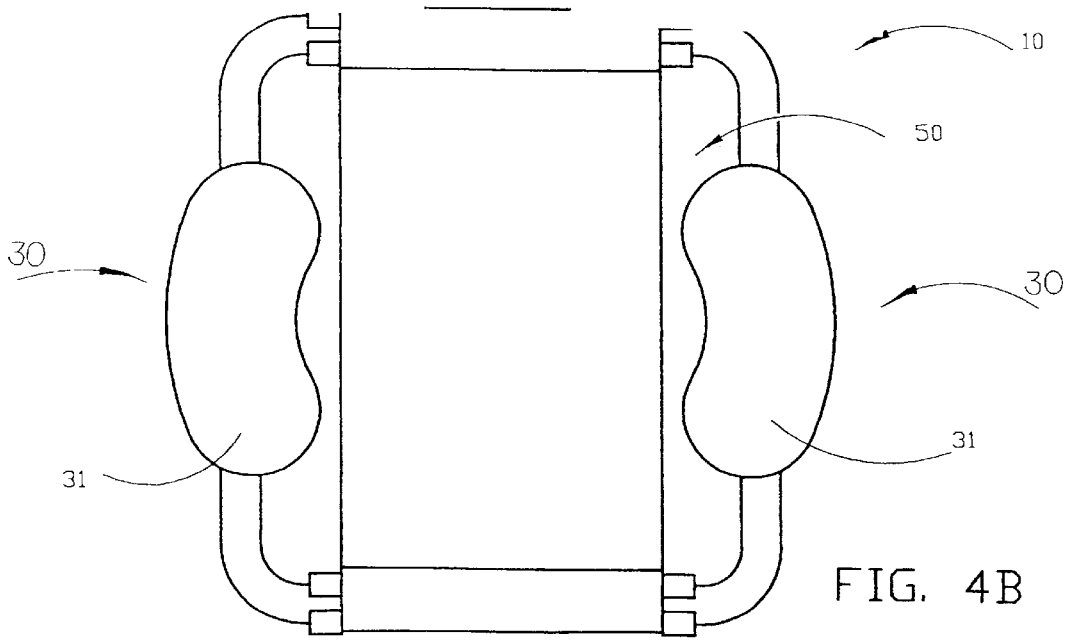
FIGS. 4A to 4D are top views of the adjustable inversion supporter according to the above preferred embodiment of the present invention, illustrating the adjustment of the distance between the two supporting pads.
Figure 4A:
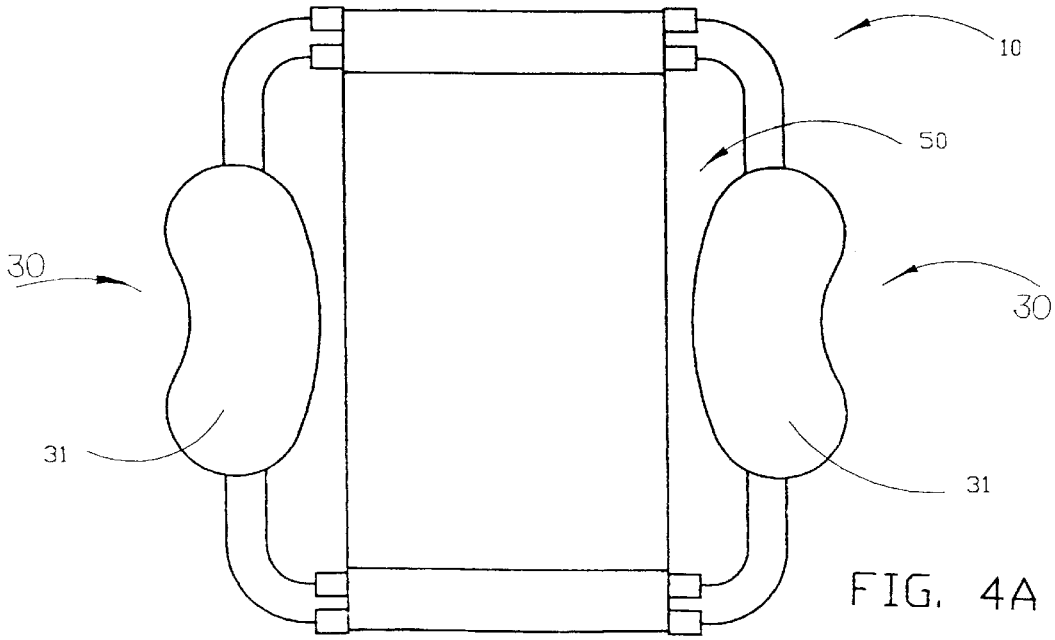
Figure 4D:
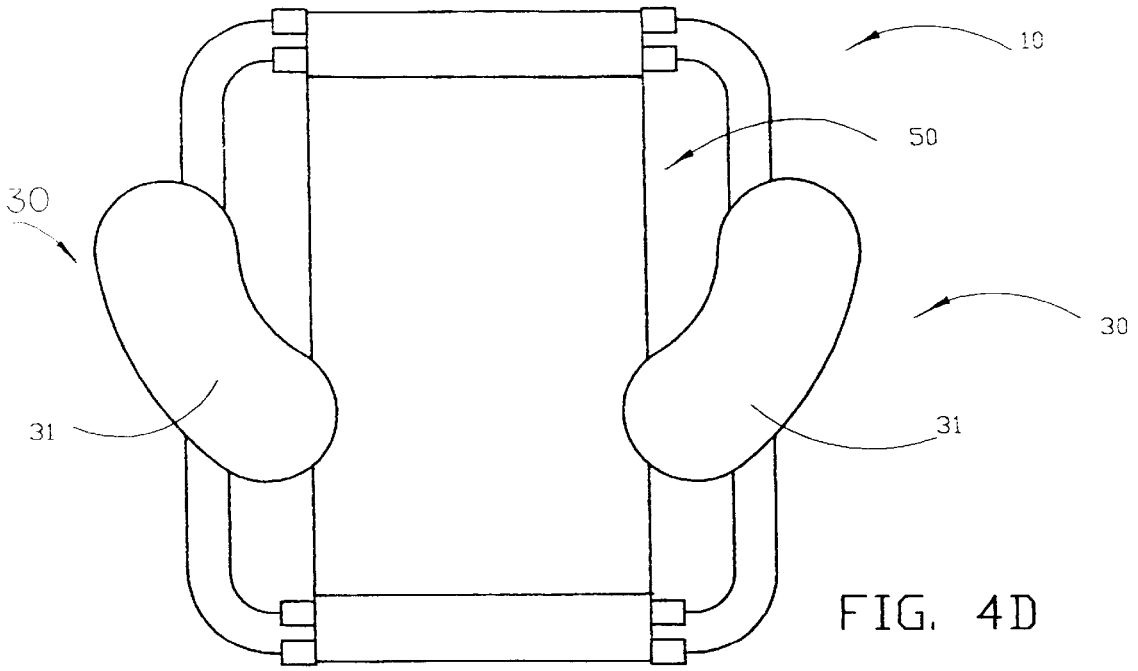
Figure 4C:
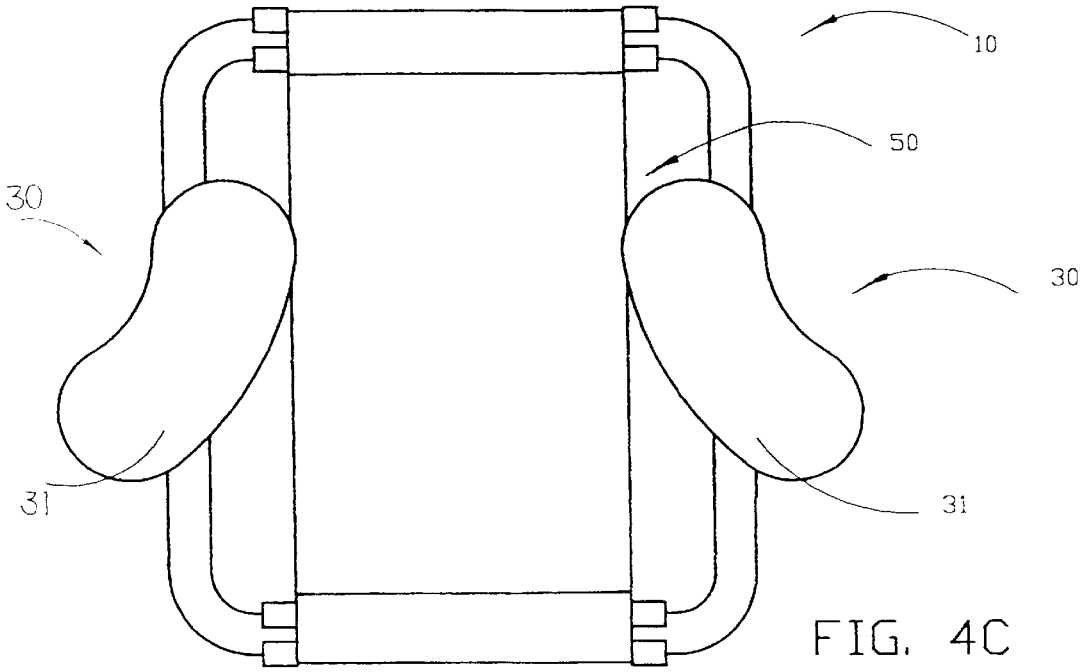
Figure 5:
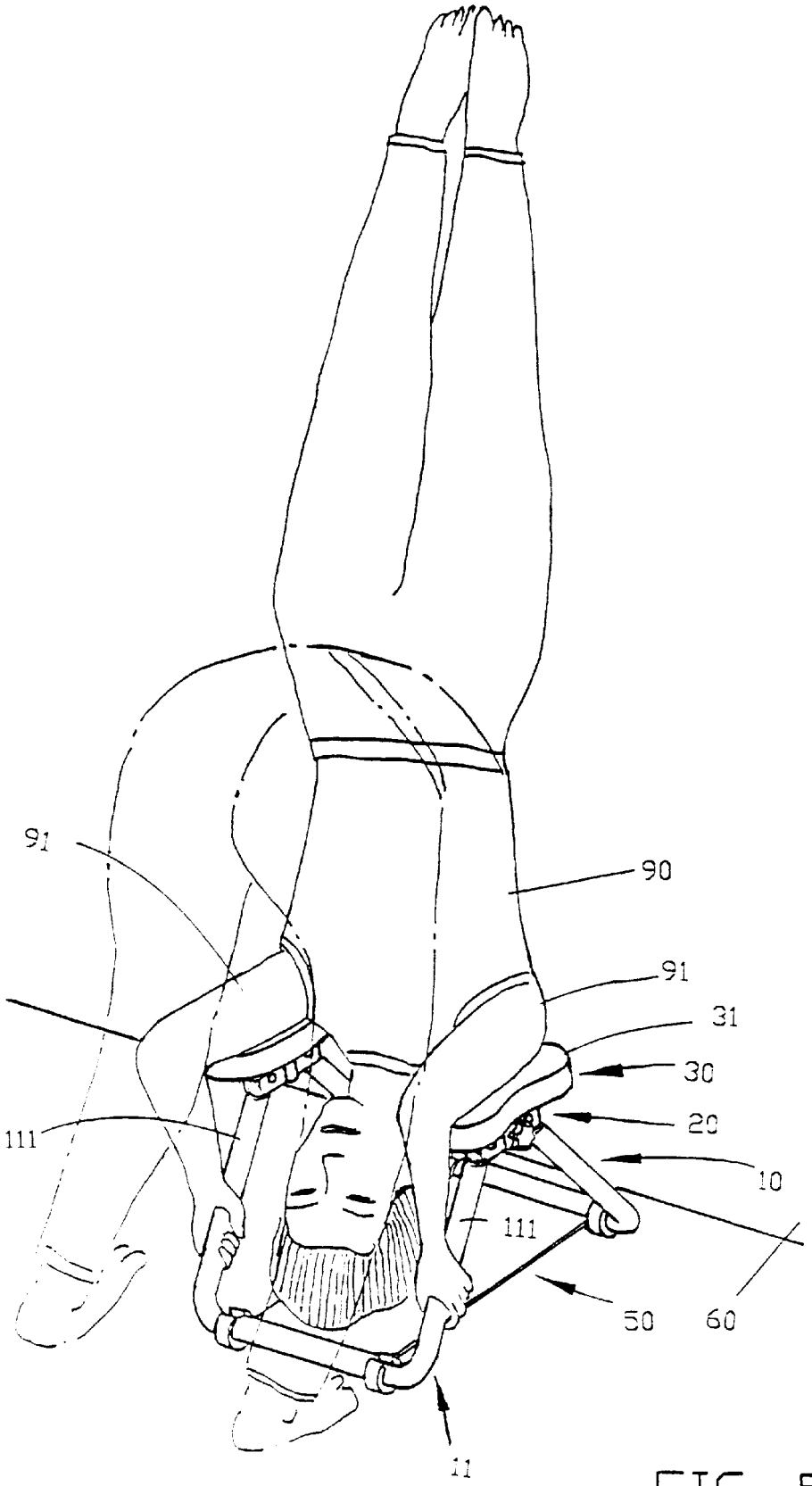
FIG. 5 is a perspective view of the adjustable inversion supporter according to the above preferred embodiment of the present invention, illustrating a user resting on the adjustable inversion supporter.

Referring to FIGS. 1 to 5 of the drawings, an adjustable inversion supporter according to a preferred embodiment of the present invention is illustrated. The adjustable inversion supporter comprises a supporting base 10, a pair of supporters 20 spacedly mounted on top of the supporting base 10, and a pair of shoulder seats 30 which are connected to the two supporters 20 respectively for supporting the two shoulders 91 of a user 90 (as shown in FIG. 5). Each of the shoulder seats 30 comprises a kidney-bean shaped supporting pad 31 for enabling the respective shoulder 91 of the inverse user 90 to rest and be supported thereon, and a seat connector 32 affixed to the supporting pad 31 for mounting the supporting pad 31 on the respective supporter 20, wherein the two supporting pads 31 are capable of adjusting a distance therebetween by altering the connection angle of the supporting pads 31 with respect to the two supporters 20 respectively. A locking means 40 may also be equipped for locking the shoulder seats 30 in position so as to prevent any undesired movement of the supporting pads 31 after the user 90 is supported thereon.

Figure 1:
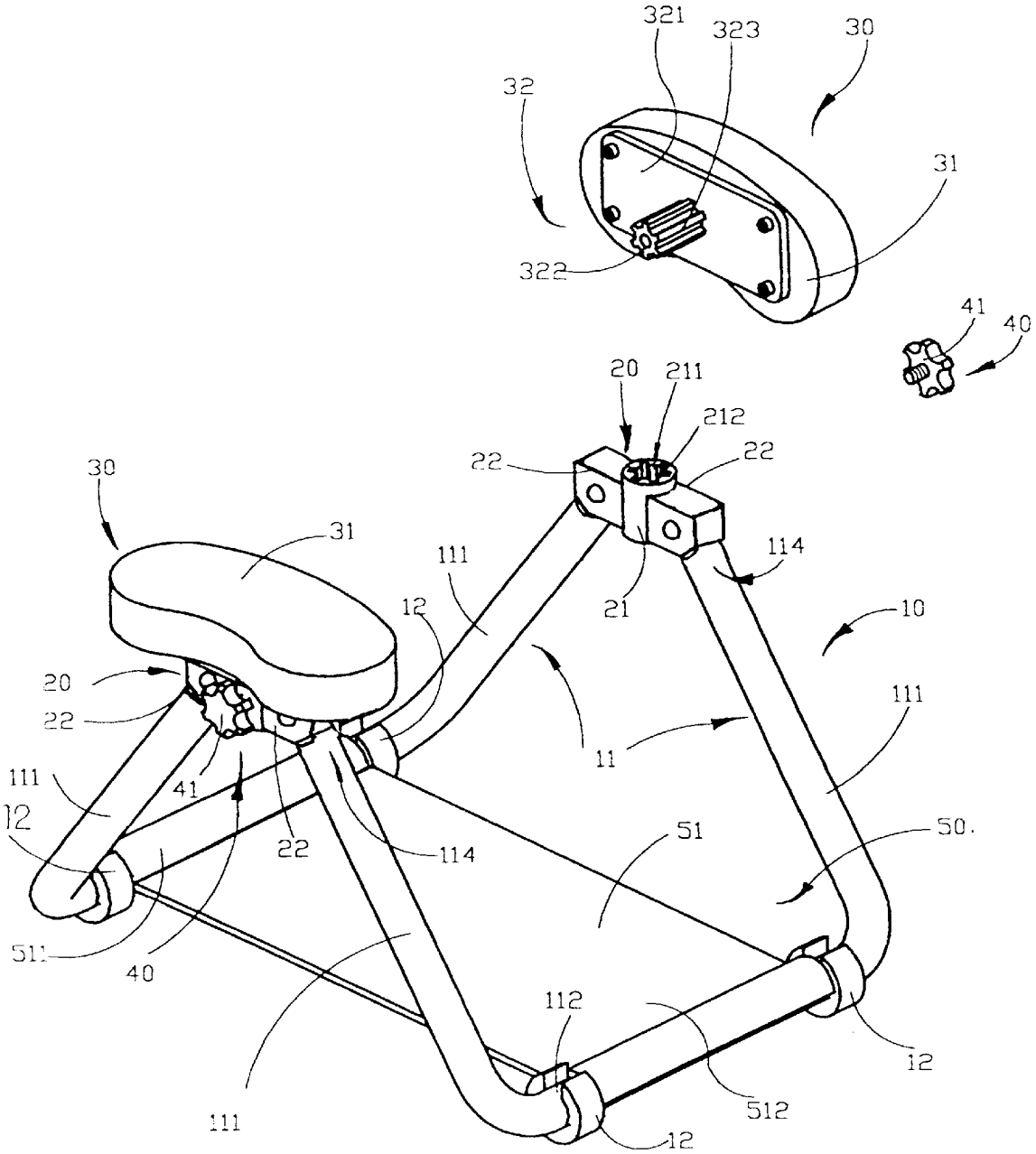
FIG. 1 is a partially exploded perspective view of an adjustable inversion supporter according to a preferred embodiment of the present invention.
Figure 2:
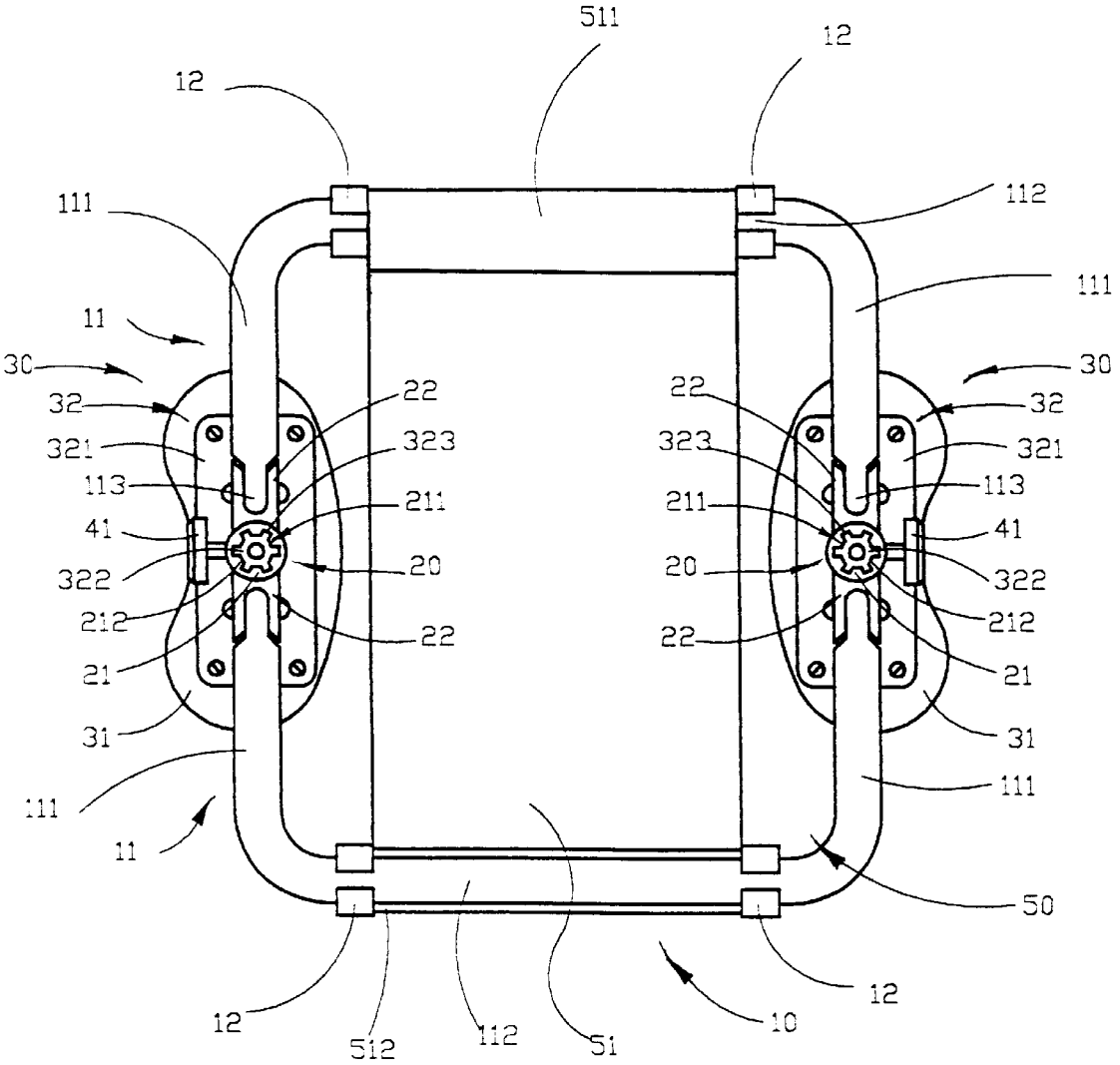
FIG. 2 is a bottom view of the adjustable inversion supporter according to the above preferred embodiment of the present invention.
Figure 3:
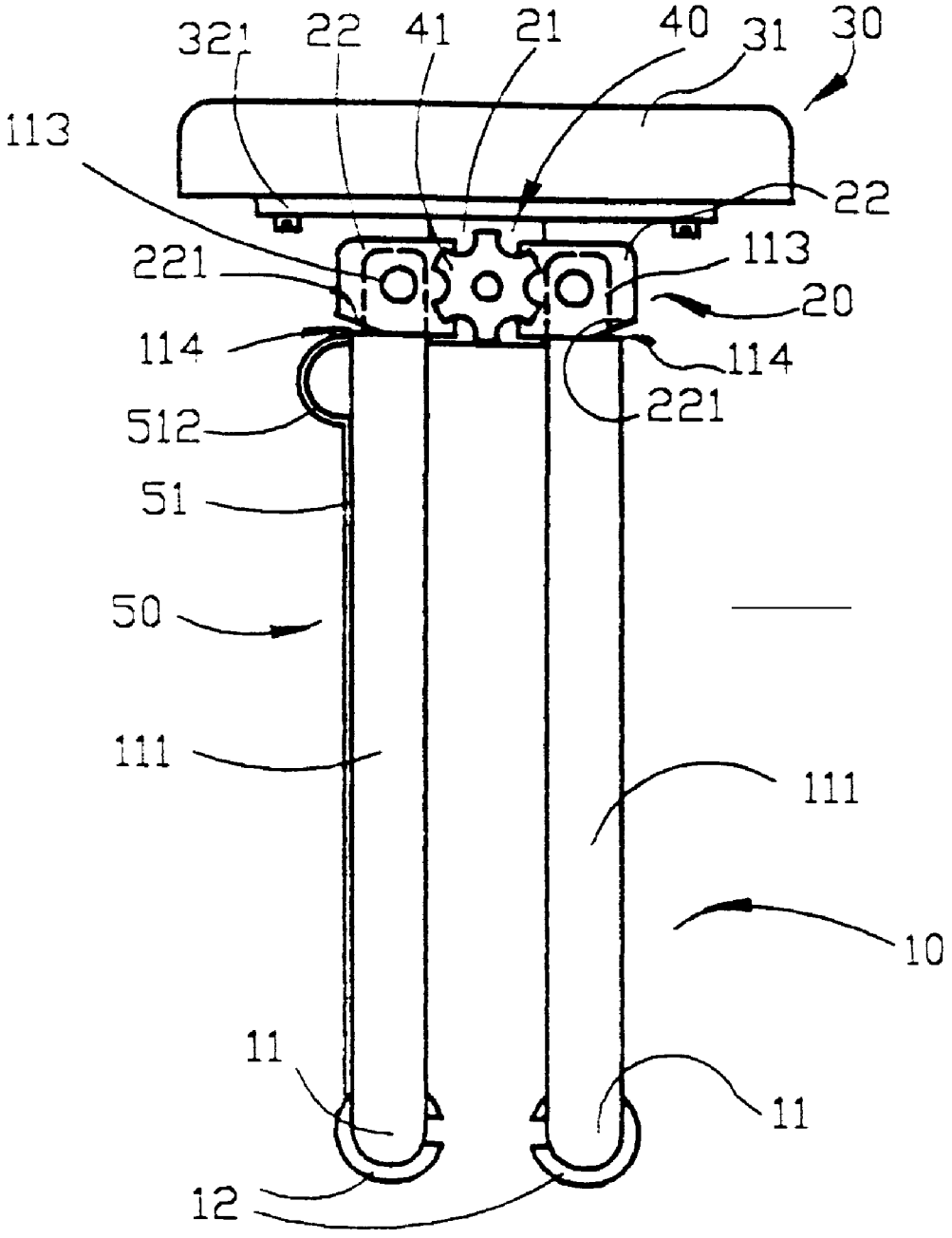
FIG. 3 is a side view of the adjustable inversion supporter according to the above preferred embodiment of the present invention, wherein the adjustable inversion supporter is folded to reduce its size when it is not in use.

As shown in FIGS. 1 to 3, the supporting base 10 comprises a pair of identical U-shape base frames 11 each having two upwardly and parallelly extended vertical rods 111 and a horizontal rod 112 integrally extended between the two vertical rods 111. Each of the two top ends of the two vertical rods 111 of each base frame 11 has a narrowed pivot member 113 and defines a shoulder edge 114. Each of the base frames II may further comprise two plastic floor mounts 12 gripped on the horizontal rod 112 to avoid slippery under pressure when the supporting base 10 sits on floor and also to prevent the floor from getting damaged or scratched.

The key structure is the pair of supporters 20 which are adapted for providing the features of enabling the supporting base 10 to fold, the two shoulder seats 30 to be detached, and the user to adjust the distance between the two shoulder seats 30 in order to fit his or her shoulder width and shape. As shown in FIGS. 1 to 3, the two supporters 20 are identical in structure and each comprises a supporting connector 21 for connecting with the seat connector 32 of the respective shoulder seat 30 and two side holders 22 for pivotally connecting with the pivot members 113 of the base frames 11 respectively, wherein each of the side holders 22 has an inclined outer bottom edge 221 (as shown in FIG. 3).

As shown in FIG. 1, the four pivot members 113 of the two base frames 11 are pivotally connected to the four side holders 22 respectively for supporting the two supporters 20 above the ground, so that when the two horizontal rod 112 of the two base frames 11 are pulled apart until the four shoulder edges 114 are respectively blocked by the four inclined outer bottom edges 221 of the four side holders 22, the two base frames 11 are fully spread out to form a V-shaped structure while viewing sidewardly.

Since triangular structure is the most rigid and strong construction, such simplest and inexpensive structure of the adjustable inversion supporter is apparently able to support more user's weight than other supporting structure in lower cost. Moreover, when the adjustable inversion supporter of the present invention is not in use, the user may push the two base frames 11 towards each other until they are in parallel, as shown in FIG. 3, so as to reduce its size for minimizing the storage space.

As shown in FIGS. 1 and 2, the supporting connector 21 has a receiving hole 211 thereon. The seat connector 32 of the each shoulder seat 30 comprises an affixing plate 321 screwed on a bottom side of the supporting pad 31 and a connecting post 322 integrally and perpendicularly extended from the affixing plate 321. To connect the shoulder seats 30 on the two supporters 20, the two connecting posts 322 of the two shoulder seats 30 are respectively inserted into the two receiving holes 211 of the two supporting connectors 21 of the two supporters 20. Since the weight of the user 90 is downwardly applied on the two shoulder seats 30 through the user's shoulders 91, as shown in FIG. 5, the two shoulder seats 30 will be pressed in position without the risk of accidentally detaching from the supporters 20.

Although tightly fitting the two connecting posts 322 into the two receiving holes 211 can prevent the two shoulder seats 30 from undesired rotation, the locking means 40 is adapted to tightly lock the two connecting posts 322 in position to prevent any rotation inside the two receiving holes 211 in order to ensure a hundred percentage safety. Referring to FIGS. 1 to 3 of the drawings, the locking means 40 comprises two locking bolts 41 for respectively screwing through the two supporting connectors 21 to press on the two connecting posts 332 of the two seat connectors 32.

Referring to FIGS. 1 and 2 of the drawing, an outer circumferential surface of each of the two connecting posts 322 provides a plurality of engaging teeth 323 longitudinally extended thereon. Moreover, an inner circumferential surface of each of the two receiving holes 211 also provides a plurality of engaging teeth 212 longitudinally extended thereon. Therefore, when the two connecting posts 322 are inserted into the two receiving holes 211 respectively, the engaging teeth 323 of the two connecting posts 322 are fittedly engaged with the engaging teeth 212 of the two receiving holes 211, so as to firmly lock the two connecting posts 322 in position. That can prevent any rotation of the two shoulder seats 30 once the user has set the relative angle of the two shoulder seats 30 to personally fit his or her shoulder shape and width. It is the most efficient and economic way for locking the two shoulder seats 30 in position.

It is worth to mention that it is an apparent modification to exchange the positions of the connecting post 322 and the receiving hole 211. In other words, each of the supporting connectors 21 may upwardly protrude a connecting tube and the receiving hole can be provided in the connecting post 322, so that two shoulder seats 30 can also be connected with the two supporters 20 by upwardly inserting the two connecting tubes into the two receiving holes formed in the connecting posts 322 respectively. Similar effect can thus be achieved.

Referring to FIGS. 1 to 3 of the drawings, in order to further ensure the operation safety and sanitation, the supporting base 10 further comprises a reinforcing frame 50 mounted between the two horizontal rods 112 for acting as a shelter to keep the user's head and hair from contacting with the ground and sharing to distribute the body weight of the user. The reinforced frame 50 comprises a rigid shelter board 51 having a first loop end 511 mounted around the horizontal rod 112 of one of the base frame 11 and a second C-shaped end 512 for clipping on the horizontal rod 112 of another base frame 11. Once the second C-shaped end 512 is hooked on the horizontal rod 112 of the respective base frame 11, the whole connection acts as a truss and the body weight of the user 90 can be evenly distributed downwards, as shown in FIG. 5.

As shown in FIG. 3, when the adjustable inversion supporter of the present invention is not in used, the user 90 may unclip the C-shaped end 512 to detach from the horizontal rod 112 of the respective base frame 11 and fold up the shelter board 51, so that the two base frames 11 and the reinforcing frame 50 can be folded up to reduce its size.

There are many means can be used to adjust a distance between two objects, such as utilizing extensible tubes to construct the base frame. However, due to the fact that when the user inverses himself or herself on top of the adjustable inversion supporter, the entire body weight (at least 80 pounds for woman and 160 pounds or more for man) of the user is loaded on the adjustable inversion supporter. In other words, the entire safety of the inversion depends on the rigidity of the adjustable inversion supporter that serious body injury may happen if the adjustable inversion supporter collapses. Therefore, it is unreasonable and unsafe to made any part of the supporting base 10 being adjustable. On the other hand, the shoulder shape and width of each person is different. It is extremely uncomfortable and also quite dangerous for a user to be supported on an inversion supporter that fails to fit the shape and width of the user's shoulders.

The above difficulty is solved by providing adjustable feature in low cost and without weaken the supporting framework according to the present invention. The kidney-bean shape of the shoulder pads 31 of the present invention is the unique solution. According to the present invention, each of the kidney-bean shaped shoulder pads 31 has a concave side. a convex side and two curved ends. Referring, to FIGS. 4A to 4D of the drawings, different combinations of the kidney-bean shaped supporting pads 21 can be achieved, enabling different users in a family to use the same adjustable inversion supporter comfortably. The present invention take advantage of geometry configuration of the special kidney-bean shape of the shoulder pads 31 which allow the user to adjust the distance between the two shoulder pads 31 by relatively turning the two shoulder pads 31 so as to fit for people with different shoulder width.

As shown in FIG. 4A, the two convex sides of the two shoulder pads 30 are confronting with each other parallelly so that a regular distance is provided between the two shoulder pads 30. As shown in FIG. 4B, the two concave sides of the two shoulder pads 30 are facing with each other parallelly that forms a farthest distance between the two shoulder pads 30 to allow a user with wider shoulder width to use the adjustable inversion supporter. As shown in FIGS. 7C and 7D, for children or women who have a narrower shoulder width, they can freely to adjust the distance between the two shoulder pads 30 by angularly connecting the two shoulder pads 30 on the two supporter 20 so as to fit the user's shoulder shape and width.

Referring to FIG. 5, by means of the adjustable inversion supporter of the present invention, the user 90 can inverse herself more easily, comfortably and safely. First, adjust the position of the two shoulder pads 31 to fit the user's shoulder shape and width. Second, the user 90 should stand in front of the adjustable inversion supporter which is placed in front of a vertical wall 60, wherein reverse V-shape construction of the supporting base 10 provides an adequate space between the user's shoulders 91 and the wall 60. Third, the user 90 can bend down to place her head between the two shoulder pads 31 and use her two hands holding on the two vertical rods 111 of the front base frame 11. Fourth, the user should rest her two shoulders 91 comfortably on the two shoulder pads 31 with her hands still holding the two vertical rods 111. When the user 90 feels comfortable, finally she can inverse herself up until her feet resting on the wall 60. At that moment, the two shoulder pads 31 support the entire body weight of the user 90. In other words, the user 90 is using her strong shoulders 91 to support her weight instead of using her hands and even her head, so that the user's head is free of any stress and load.

I claim:

1. An adjustable inversion supporter, comprising a supporting base;

a pair of supporters which are spacedly mounted on top of said supporting base each comprising a supporting connector, wherein each of said supporting connectors has a receiving hole thereon;

a pair of shoulder seats each comprising a supporting pad and a seat connector which is affixed to said respective supporting pad and rotatably connected with said respective supporting connector, so as to mount said two supporting pads on top of said two supporters respectively, wherein a distance between said two supporting pads is able to be adjusted by relatively turning said two shoulder seats with respect to said two supporter, wherein each of said seat connectors comprises a connecting post downwardly extended from said respective shoulder pad, said two connecting posts of said two shoulder seats being respectively inserted into said two receiving holes of said two supporting connectors of said two supporters, wherein an outer circumferential surface of each of said two connecting posts provides a plurality of engaging teeth longitudinally extended thereon, and an inner circumferential surface of each of said two receiving holes also provides a plurality of engaging teeth longitudinally extended thereon, therefore when said two connecting posts are inserted into said two receiving holes respectively, said engaging teeth of said two connecting posts are fittedly engaged with said engaging teeth of said two receiving holes, so as to firmly lock said two connecting posts in position; and a locking means for locking said shoulder seats in position so as to prevent any undesired movement of said supporting pads once said distance between said two supporting pads is set, wherein said locking means comprises two locking bolts for respectively screwing through said two supporting connectors to press on said two connecting posts of said two seat connectors.

2. An adjustable inversion supporter, as recited in claim 1, wherein said supporting base comprises a pair of identical U-shape base frames each having two upwardly and parallelly extended vertical rods and a horizontal rod integrally extended between said two vertical rods, two top ends of said two vertical rods of each of said base frames each having a narrowed pivot member, wherein each of said two supporters further comprises two side holders for pivotally connecting with said pivot members of said base frames respectively.

3. An adjustable inversion supporter, as recited in claim 2, wherein each of said top ends of said two vertical rods further defines a shoulder edge and each of said side holders has an inclined outer bottom edge, and that said four pivot members of said two base frames are pivotally connected to said four side holders respectively for supporting said two supporters, and that when said two horizontal rod of said two base frames are pulled apart until said four shoulder edges are respectively blocked by said four inclined outer bottom edges of said four side holders, said two base frames are fully spread out to form a V-shaped structure while viewing sidewardly, moreover, when said adjustable inversion supporter is not in use, said two base frames are able to push towards each other to reduce the size thereof.

4. An adjustable inversion supporter, as recited in claim 3, wherein said supporting base further comprises a plurality of floor mounts which are respectively gripped on said two horizontal rods to avoid slippery under pressure when said supporting base sits on a floor and also to prevent said floor from getting damaged or scratched.

5. An adjustable inversion supporter, as recited in claim 4, wherein said supporting base further comprises a reinforcing frame mounted between said two horizontal rods, said reinforced frame comprising a rigid shelter board having a first loop end mounted around said horizontal rod of one of said base frame and a second C-shaped end for detachably clipping on said horizontal rod of another base frame.

6. An adjustable inversion supporter, comprising a supporting base;

a pair of supporters which are spacedly mounted on top of said supporting base each comprising a supporting connector, wherein each of said supporting connectors has a receiving hole thereon; and a pair of shoulder seats each comprising a supporting pad and a seat connector which is affixed to said respective supporting pad and rotatably connected with said respective supporting connector, so as to mount said two supporting pads on top of said two supporters respectively, wherein a distance between said two supporting pads is able to be adjusted by relatively turning said two shoulder seats with respect to said two supporter, wherein each of said seat connectors comprises a connecting post downwardly extended from said respective shoulder pad, said two connecting posts of said two shoulder seats being respectively inserted into said two receiving holes of said two supporting connectors of said two supporters, wherein an outer circumferential surface of each of said two connecting posts provides a plurality of engaging teeth longitudinally extended thereon, and an inner circumferential surface of each of said two receiving holes also provides a plurality of engaging teeth longitudinally extended thereon, therefore when said two connecting posts are inserted into said two receiving holes respectively, said engaging teeth of said two connecting posts are fittedly engaged with said engaging teeth of said two receiving holes, so as to firmly lock said two connecting posts in position.

7. An adjustable inversion supporter, as recited in claim 6, wherein said supporting base comprises a pair of identical U-shape base frames each having two upwardly and parallelly extended vertical rods and a horizontal rod integrally extended between said two vertical rods, two top ends of said two vertical rods of each of said base frames each having a narrowed pivot member, wherein each of said two supporters further comprises two side holders for pivotally connecting with said pivot members of said base frames respectively.

8. An adjustable inversion supporter, as recited in claim 7, wherein each of said top ends of said two vertical rods further defines a shoulder edge and each of said side holders has an inclined outer bottom edge, and that said four pivot members of said two base frames are pivotally connected to said four side holders respectively for supporting said two supporters, and that when said two horizontal rod of said two base frames are pulled apart until said four shoulder edges are respectively blocked by said four inclined outer bottom edges of said four side holders, said two base frames are fully spread out to form a V-shaped structure while viewing sidewardly, moreover, when said adjustable inversion supporter is not in use, said two base frames are able to push towards each other to reduce the size thereof.

9. An adjustable inversion supporter, as recited in claim 8, wherein said supporting base further comprises a plurality of floor mounts which are respectively gripped on said two horizontal rods to avoid slippery under pressure when said supporting base sits on a floor and also to prevent said floor from getting damaged or scratched.

10. An adjustable inversion supporter, as recited in claim 9, wherein said supporting base further comprises a reinforcing frame mounted between said two horizontal rods, said reinforced frame comprising a rigid shelter board having a first loop end mounted around said horizontal rod of one of said base frame and a second C-shaped end for detachably clipping on said horizontal rod of another base frame.

11. An adjustable inversion supporter, comprising a supporting base, wherein said supporting base comprises a pair of identical U-shape base frames each having two upwardly and parallelly extended vertical rods and a horizontal rod integrally extended between said two vertical rods, two top ends of said two vertical rods of each of said base frames each having a narrowed pivot member, wherein each of said top ends of said two vertical rods further defines a shoulder edge and each of said side holders has an inclined outer bottom edge;

a pair of supporters, which are spacedly mounted on top of said supporting base, each comprising a supporting connector and two side holders for pivotally connecting with said pivot members of said base frames respectively, wherein said four pivot members of said two base frames are pivotally connected to said four side holders respectively for supporting said two supporters; and a pair of shoulder seats each comprising a supporting pad and a seat connector which is affixed to said respective supporting pad and rotatably connected with said respective supporting connector, so as to mount said two supporting pads on top of said two supporters respectively, wherein a distance between said two supporting pads is able to be adjusted by relatively turning said two shoulder seats with respect to said two supporter, wherein when said two horizontal rod of said two base frames are pulled apart until said four shoulder edges are respectively blocked by said four inclined outer bottom edges of said four side holders, said two base frames are fully spread out to form a V-shaped structure while viewing sidewardly, moreover when said adjustable inversion supporter is not in use, said two base frames are able to push towards each other to reduce the size thereof.

12. An adjustable inversion supporter, as recited in claim 11, wherein said supporting base further comprises a plurality of floor mounts which are respectively gripped on said two horizontal rods to avoid slippery under pressure when said supporting base sits on a floor and also to prevent said floor from getting damaged or scratched.

13. An adjustable inversion supporter, comprising a supporting base, which comprises a pair of identical U-shape base frames each having two upwardly and parallelly extended vertical rods and a horizontal rod integrally extended between said two vertical rods, two top ends of said two vertical rods of each of said base frames each having a narrowed pivot member, and reinforcing frame mounted between said two horizontal rods, wherein said reinforced frame comprises a rigid shelter board having a first loop end mounted around said horizontal rod of one of said base frame and a second C-shaped end for detachably clipping on said horizontal rod of another base frame;

a pair of supporters which are spacedly mounted on top of said supporting base each comprising a supporting connector, wherein each of said two supporters further comprises two side holders for pivotally connecting with said pivot members of said base frames respectively; and a pair of shoulder seats each comprising a supporting pad and a seat connector which is affixed to said respective supporting pad and rotatably connected with said respective supporting connector, so as to mount said two supporting pads on top of said two supporters respectively, wherein a distance between said two supporting pads is able to be adjusted by relatively turning said two shoulder seats with respect to said two supporter.

* * * * *